US006127614A

United States Patent [19]

Lombardi

[11] Patent Number: 6,127,614

[45] Date of Patent: Oct. 3, 2000

[54] TAMBOURINE INCLUDING AUXILIARY SOUND PRODUCING MECHANISM

[75] Inventor: Donald G. Lombardi, Thousand Oaks, Calif.

[73] Assignee: Drum Workshop, Inc., Oxnard, Calif.

[21] Appl. No.: 09/293,799

[22] Filed: Apr. 19, 1999

[51] Int. Cl.[7] ..... G10D 13/02

[52] U.S. Cl. ..... 84/418; 84/419

[58] Field of Search ..... 84/402, 403, 411, 84/418, 419, 422.2, 422.3; D17/22

[56] References Cited

U.S. PATENT DOCUMENTS

| | | | |
|---|---|---|---|
| D. 206,134 | 11/1966 | Gussak | D17/22 |
| D. 211,964 | 8/1968 | Valente | D17/22 |
| D. 220,002 | 2/1971 | Barker | D17/4 |
| D. 231,797 | 6/1974 | Hoey | D17/4 |
| D. 259,047 | 4/1981 | Taninbaum . | |
| D. 268,419 | 3/1983 | Taninbaum . | |
| D. 350,558 | 9/1994 | Huang | D17/22 |
| D. 386,779 | 11/1997 | Burgos | D17/22 |
| 1,576,443 | 3/1926 | McElhany | 84/418 |
| 3,215,020 | 11/1965 | Kester, Jr. | 84/422.3 |
| 3,704,340 | 11/1972 | Hall | 84/170 |
| 4,230,015 | 10/1980 | Taninbaum | 84/418 |
| 4,346,637 | 8/1982 | Janszen | 84/418 |
| 4,843,944 | 7/1989 | Shimoda | 84/418 |
| 5,284,079 | 2/1994 | Wang | 84/418 |
| 5,355,760 | 10/1994 | Bein et al. | 84/418 |
| 5,567,898 | 10/1996 | Shalev | 84/418 |

FOREIGN PATENT DOCUMENTS

| | | |
|---|---|---|
| 1382900 | 11/1964 | France . |
| 4112238 | 10/1992 | Germany . |

*Primary Examiner*—Robert E. Nappi
*Assistant Examiner*—Kim Lockett
*Attorney, Agent, or Firm*—WIlliam W. Haefliger

[57] ABSTRACT

In a tambourine, the combination comprises a frame extending at least in part along an extended path, multiple jingles carried by the frame at selected locations along the path, and auxiliary plates carried at an auxiliary selected location relative to path and characterized as clashing to produce a different sound than the jingles' sounds when the tambourine frame is impacted near the auxiliary plates.

7 Claims, 3 Drawing Sheets

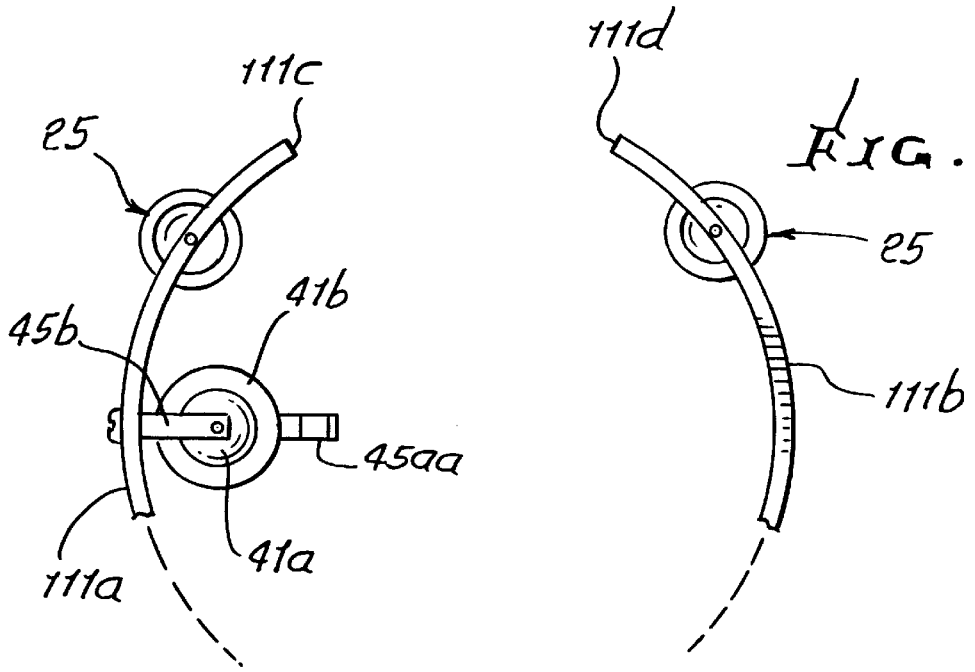
FIG. 6.
FIG. 7.
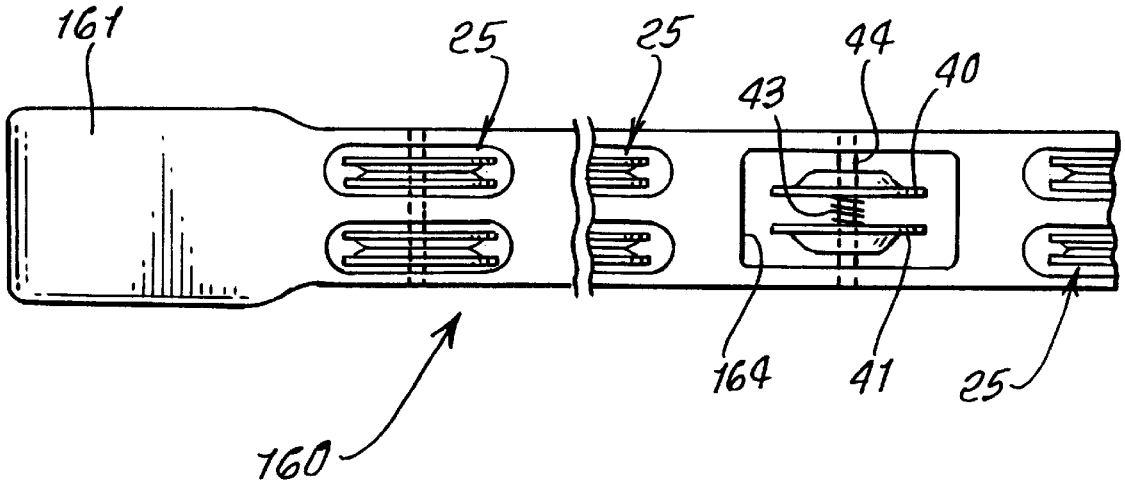

TAMBOURINE INCLUDING AUXILIARY SOUND PRODUCING MECHANISM

BACKGROUND OF THE INVENTION

This invention relates generally to tambourines, and more particularly to improvements in tambourines enabling their play to produce selectively different sounds.

Tambourines conventionally comprise a looping frame and multiple like jingles carried by the frame to produce like jingling sounds when the tambourine is shaken or struck. It would be desirable at times during play of the tambourine to produce a different and additional sound, and especially selectively so that such different sound would only be produced when the tambourine is locally and selectively struck. There is need for an improved tambourine embodying such improvements.

SUMMARY OF THE INVENTION

It is a major object of the invention to provide an improved tambourine meeting the above need. Basically the improved tambourine comprises a) a frame extending at least in part along a looping path, b) multiple jingles carried by the frame at selected locations along said path, c) and auxiliary plates carried to produce a different sound than the jingles' sounds when the tambourine frame is impacted near said auxiliary plates, the auxiliary plates offset as will be seen to enhance their selective clashing.

Typically, the auxiliary plates are supported to remain separated immediately prior to frame local impacting to produce said clashing; further, at least one spring is typically located to yieldably bias at least one of the auxiliary plates to maintain the plates separated until occurrence of such local impacting. The spring may comprise a compression type coil spring located between the auxiliary plates.

Another object is to provide an auxiliary shaft carried by the frame, and on which the plates are mounted for relative movement toward and away from one another, the spring extending adjacent that shaft. In this regard, the auxiliary plates may be located in offset relation to the frame looping path.

Another object is to provide the frame to have a supported portion thereof extending re-entrantly relative to a zone bounded at least in part by said looping path. The auxiliary plates are typically offset toward that zone; and the frame may include a hand hold at the hand supported portion of the frame, and projecting toward the auxiliary plates.

A further object is to provide the frame to have generally crescent shape, and spaced apart opposite edges, the jingles and plate being located between planes defined by those opposite edges.

Yet another object is to provide a tambourine to have multiple jingles shafts carried by the frame, and the jingles comprising thin plates through which the jingles shafts loosely extend, and wherein the auxiliary plates have cymbals configuration for clashing of edge portions of the auxiliary plates.

These and other objects and advantages of the invention, as well as the details of an illustrative embodiment, will be more fully understood from the following specification and drawings, in which:

DRAWING DESCRIPTION

FIGS. 6 and 7 show modifications to the tamborine frame.

DETAILED DESCRIPTION

Figure 1:
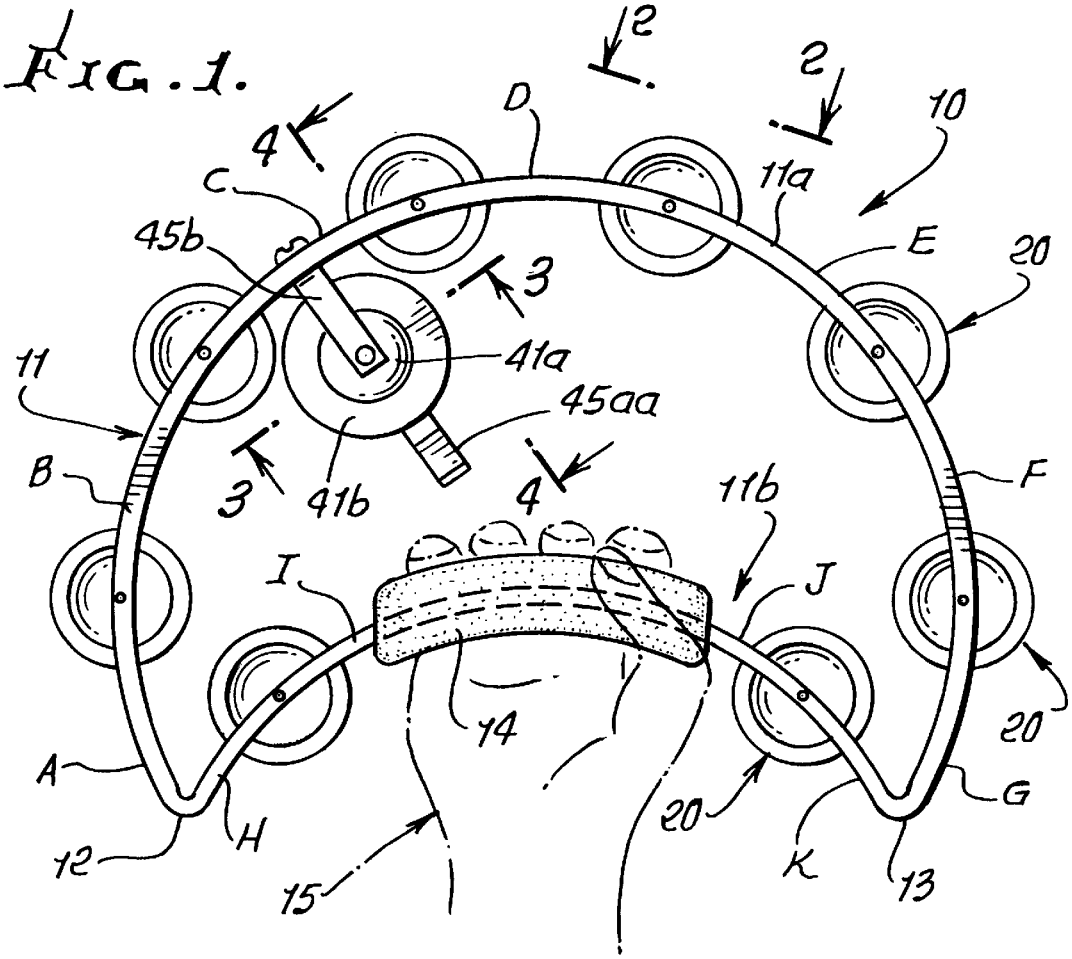
FIG. 1 is a front elevation view of a tambourine incorporating the invention.
Figure 2:
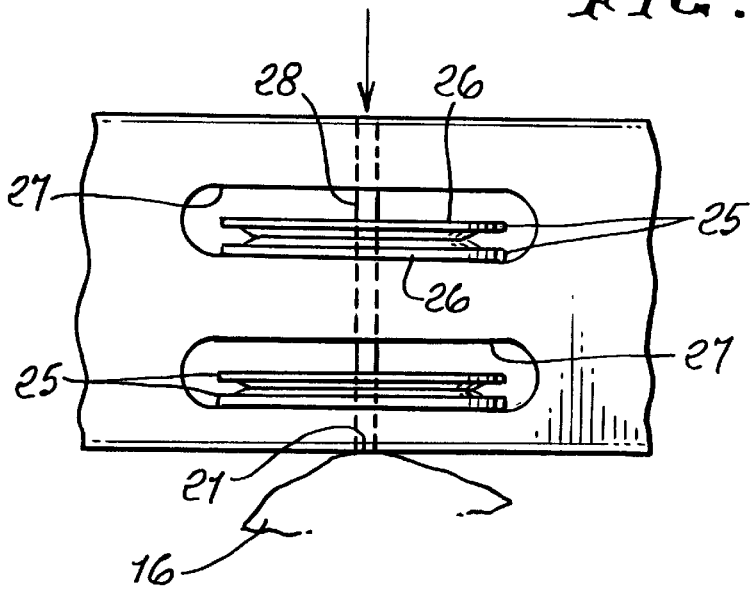
FIG. 2 is a fragmentary view taken on lines 2—2 of FIG. 1.

In FIGS. 1–4, a preferred tambourine 10 has a frame 11 that forms a generally crescent overall shape, and which includes a first portion 11*a* that extends in part along a looping path A--G between corners 12 and 13. Path A--G is outwardly convex, as shown. The frame has a re-entrant portion 11*b* that extends along path H--K between corners 12 and 13. That path is outwardly concave. Portion 11*b* includes a handle indicated at 14, close to the center of gravity of the tambourine, so that the instrument is easy to manually manipulate. Note the user's hand indicated generally at 15, for shaking the tambourine back and forth, whereby jingles 20 on the tambourine produce their characteristic jingling sound. They also produce a sudden impact sound when the tambourine frame is impacted against an object 21 such as the player's other hand 16, as in FIG. 2.

The jingles 20 typically comprise pairs 25 of like metallic discs 26 carried within slots 27 of the frame. The pairs of discs are loosely received on carrier pins 28 attached to the frame, as is clear from FIG. 2, whereby the thin metallic discs of each pair slide back and forth on the pins and strike each other to produce the characteristic jingling sound, represented by an audible frequency range $f_1$ to $f_2$, as the tambourine is displaced back and forth. The jingles are carried at selected locations along the frame path or paths, as seen in FIG. 1. Two pairs of jingles are carried at each selected location, as is clear from FIG. 2, two slots 27 formed in the frame at such locations. Pins 28 extend normal to the plane of the frame.

In accordance with the invention, auxiliary plates are carried at an auxiliary selected location relative to said path and characterized as clashing to produce a different sound than the sounds that jingle when the tambourine frame is impacted near said auxiliary plates. The different clashing sound may be represented by the audible frequency range $f_3$ to $f_4$, whereby a significant part of the range $f_3$ to $f_4$ lies outside the range $f_1$ to $f_2$.

Figure 3:
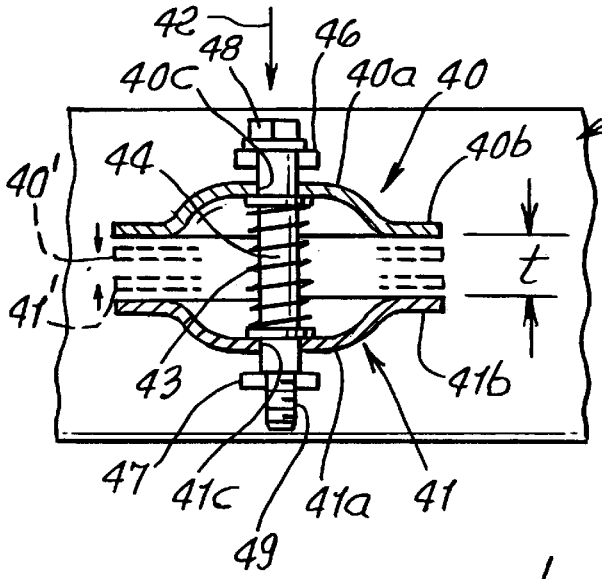
FIG. 3 is a fragmentary view taken on lines 3—3 of FIG. 1.
Figure 4:
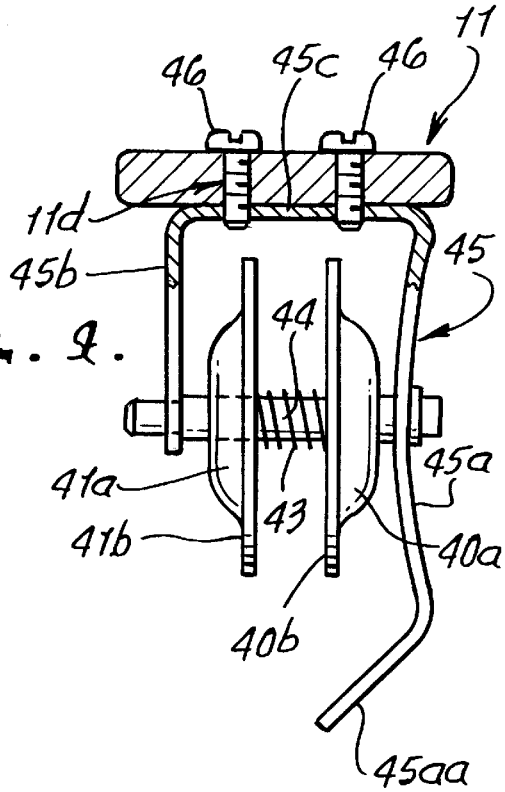
FIG. 4 is a fragmentary view taken on lines 4—4 of FIG. 1.

As seen in FIGS. 3 and 4, there are two such like auxiliary plates 40 and 41, generally in the form of cymbals, each having a domed mid-portion 40*a* and 41*a*, and a disc-shaped annular outer portion 40*b* and 41*b*. They are supported to remain separated immediately prior to impacting of the frame portion as at 42, close to the two plates, as seen in FIG. 3. For this purpose, a coil spring 43 is preferably located between the plates, to extend about a shaft 44 on which the plates are slidable. Note the holes 40*c* and 41*c* in the domed mid-portions of the plates, which loosely fit the shaft, allowing the plates to slide on the shaft and clash (see broken lies 40' and 41") in response to striking of the frame in the direction of arrow 42. Washers 46 and 47 are adjustably retained on the shaft at 48 and 49, to engage the plates and establish the gap "t" between the plates, prior to plate sliding on the shafts.

The gap "t" is adjusted so that the plates do not slide on the shaft and clash, in response to hand impact with the frame as at zones A, B, D, E, F and G to cause sounding of the jingles; but to allow plate sliding and clashing in response to hand impact with the frame at zone C, even though the jingles also impact and sound, as by bouncing off the frame interior walls 27.

Note further that the metallic plates 40 and 41 have thickness "$d_1$", which is substantially greater than the thickness "$d_2$" of the jingle plates.

Shaft 44 is retained in position by arms 45*a* and 45*b* of a U-shaped metallic retainer 45. The mid-portion 45*c* of the retainer is attached as by fasteners 46 to the frame 11, at 11*d*. A diagonal extension 45*aa* of arm 45*a* faces the hand hold zone to protect against finger engagement with the plates 40 and 41. Metallic arms 45*a* and 45*b* tend to resonate and enhance the clashing sounds of the plates 40 and 41.

Plates 40 and 41 are offset from the frame curved path A-G, and toward the hand-hold zone. Plate discs 40*b* and 41*b* extend generally parallel to the frame looping, curved path. Shaft 44 extends generally parallel to the jingles' pins 28.

Figure 5:
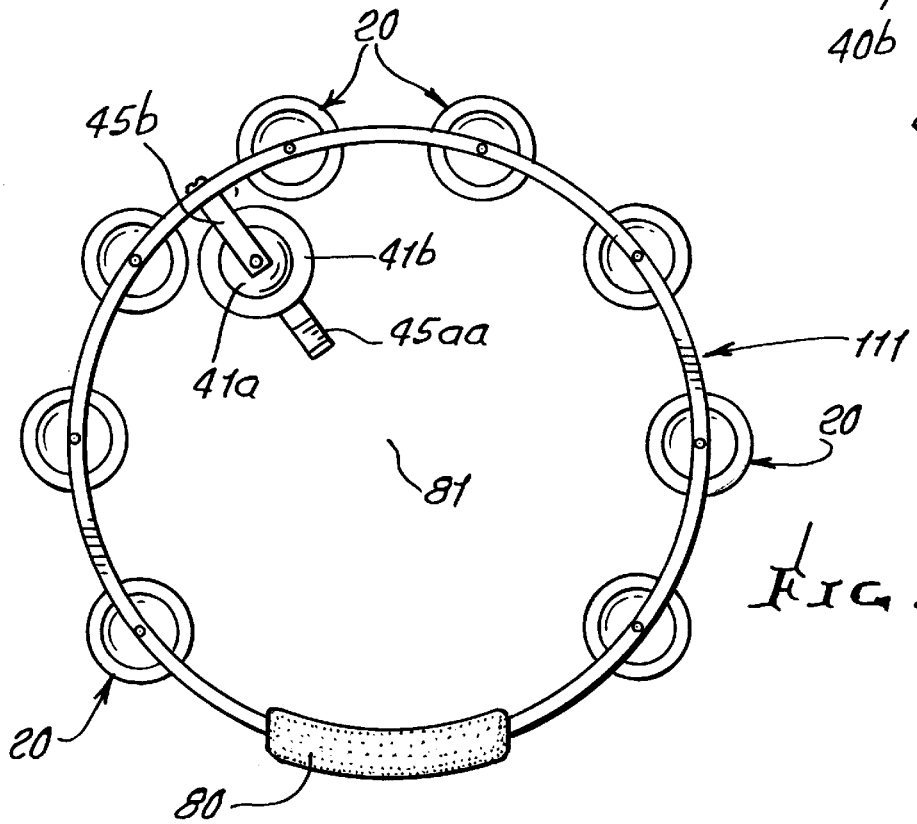
FIG. 5 is a view like FIG. 1, but showing a modified tambourine frame.

FIG. 5 shows a tambourine structure like that of FIGS. 1–4, except that the frame 111 is generally circular or looping throughout, i.e. outwardly convex, whereby the hand hold 80 is not offset or re-entrant toward the center of gravity 81.

While the plates 40 and 41 are shown offset from the frame 11, they can be carried in a looping or circular sequence with the jingles.

In FIG. 6 the modified tambourine 150 is like the tambourine shown in FIG. 5, except that it has a gap 151 between two arc-shaped portions 111*a* and 111*b* of the frame 111. Note that the frame portions in general are spaced apart and have spaced terminals 111*c* and 111*d*.

In FIG. 7 the modified frame 160 extends along a substantially straight path, and a handle is provided at 161. Jingles are shown at 25, and correspond to those discussed above. Auxiliary plate 40 and 41 correspond in structure and function to those described above and are located at a point lengthwise of the frame. A frame opening 164 receives the plates, support post or pin 44, and spring 43 located between the plates.

I claim:

1. A tambourine, comprising a) a frame extending at least in part along an extended path, b) multiple jingles carried by the frame at selected locations along said path, c) and thin auxiliary plates carried at an auxiliary selected location relative to said path and characterized as clashing to produce a different sound than the jingles' sounds when the tambourine frame is impacted near said auxiliary plates, d) the frame having a hand supported portion thereof extending re-entrantly relative to a zone bounded at least in part by said path which is a looping path, e) and including at least one spring located between the auxiliary plate to yieldable bias at least one of said auxiliary plates to maintain the plates separated until occurrence of said impacting, said auxiliary plates and spring being offset from said path and toward said zone, and toward said hand supported portion.

2. The tambourine of claim 1 wherein the auxiliary plates are supported on a shaft carried by metallic arms connected to the frame, to remain separated immediately prior to said impacting to produce said clashing.

3. The tambourine of claim 1 wherein said spring is located between said auxiliary plates.

4. The tambourine of claim 3 including an auxiliary shaft carried by the frame, and on which said plates are mounted for relative movement toward and away from one another, the spring extending adjacent said shaft.

5. The tambourine of claim 1 wherein said frame has generally crescent shape, and spaced apart opposite edges, and said jingles and plates are located between planes defined by said opposite edges.

6. The tambourine of claim 1 including jingles pins carried by the frame, and said jingles comprise thin plates through which said jingles pins loosely extend, and wherein said auxiliary plates have cymbals configuration for clashing of edge portions of the auxiliary plates.

7. The tambourine of claim 1 wherein said path is a looping path.

* * * * *